United States Patent [19]

Künzli et al.

[11] Patent Number: 4,601,186

[45] Date of Patent: Jul. 22, 1986

[54] PROCESS AND APPARATUS FOR ACHIEVING NARROW WORKPIECE TOLERANCES IN DROP-FORGING, ESPECIALLY IN ISOTHERMAL FORGING

[75] Inventors: Roland Künzli, Mellingen; Hans Rydstad, Birmenstorf, both of Switzerland

[73] Assignee: BBC Brown, Boveri & Co., Ltd., Baden, Switzerland

[21] Appl. No.: 701,519

[22] Filed: Feb. 14, 1985

[30] Foreign Application Priority Data

Mar. 2, 1984 [CH] Switzerland ..... 1035/84

[51] Int. Cl.[4] ..... B21D 72/00

[52] U.S. Cl. ..... 72/21; 72/352

[58] Field of Search ..... 72/16, 21, 22, 352, 72/377

[56] References Cited

U.S. PATENT DOCUMENTS 4,306,436 12/1981 Schulz ..... 72/21
4,408,471 10/1983 Gossard ..... 72/21
4,489,518 12/1984 Nagai ..... 72/21
4,531,901 7/1985 Andersen ..... 72/21

*Primary Examiner*—Leon Gilden
*Attorney, Agent, or Firm*—Oblon, Fisher, Spivak, McClelland & Maier

[57] ABSTRACT

A process and apparatus for achieving narrow workpiece tolerances in isothermal drop-forging, the relative movement of the two die halves (1, 2) in an xy plane perpendicular to the pressing direction z being measured and monitored by means of an optical measuring device (10, 11, 12, 14) or mechanical measuring device (14, 15, 16) and being corrected by means of a mechanical adjusting device (6, 17, 21, 23, 24, 25, 26) for one die half (2). A first workpiece is forged, and the divergence from the nominal value is measured, with the die halves (1, 2) closed, the die halves (1, 2) are opened, the first workpiece is removed, the position of one die half (2) is corrected, and a new workpiece is introduced and forged completely, without the workpiece having to be cooled and remeasured and without the die having to be cooled and reheated.

4 Claims, 8 Drawing Figures

Figure 1:
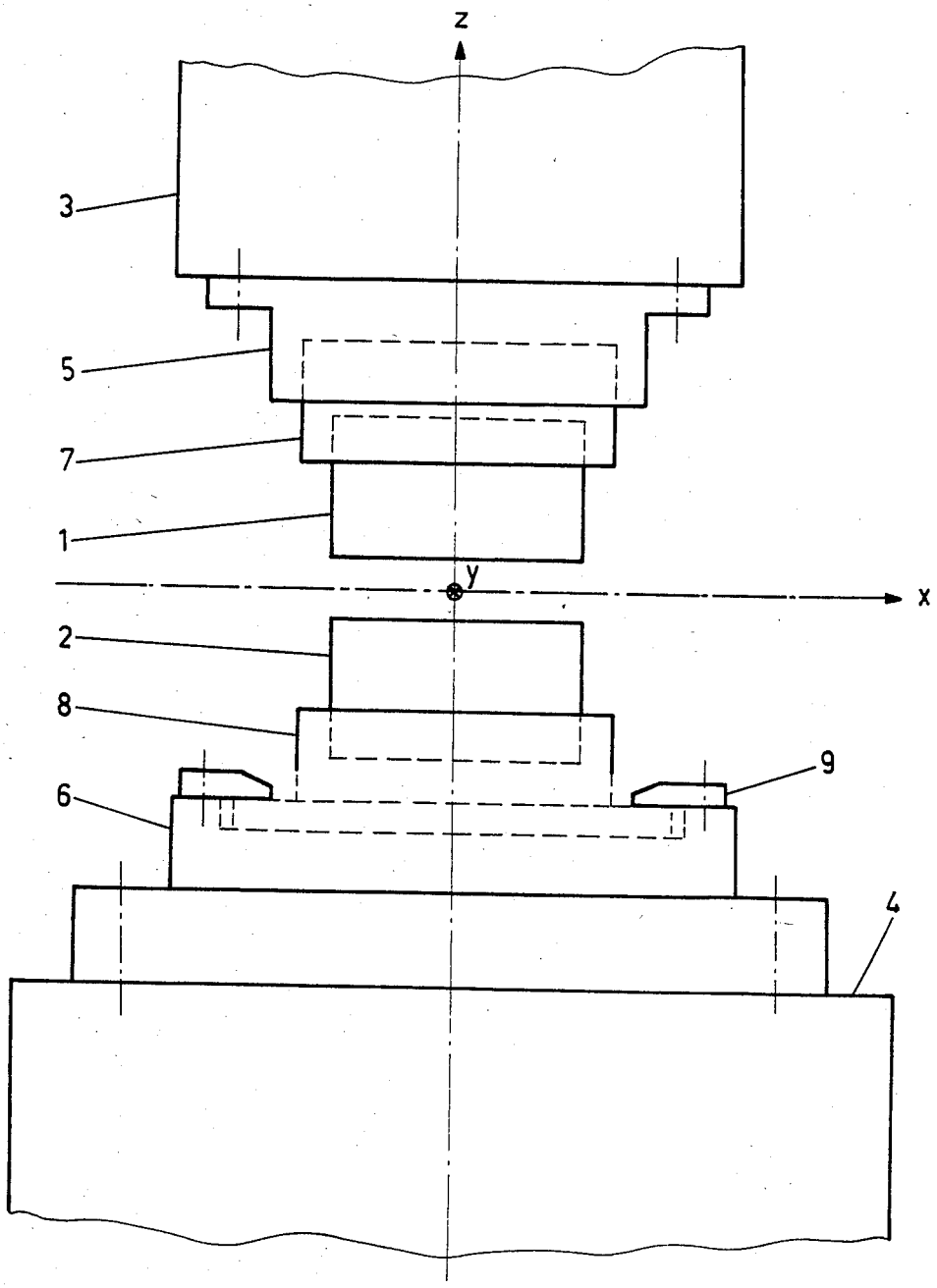

PROCESS AND APPARATUS FOR ACHIEVING NARROW WORKPIECE TOLERANCES IN DROP-FORGING, ESPECIALLY IN ISOTHERMAL FORGING

The invention starts from a process for achieving narrow workpiece tolerances in drop-forging, of the generic type according to the pre-characterizing clause of claim 1, and from an apparatus of the generic type according to the pre-characterizing clause of claim 5.

In the drop-forging of relatively complicated asymmetrical workpieces, the two die halves experience, as they approach one another during the pressing operation, a relative movement in the plane (xy) perpendicular to the pressing direction (z). This relative movement, which generally consists of displacements and rotations and which largely determines the workpiece tolerance which can be achieved, can be caused by inadequate guidance, deformations of thermal and/or mechanical origin, asymmetrical yield forces and frictional forces of the material to be forged, etc. In conventional forging, attempts have already been made to counteract these movements by means of appropriate additional guides for the dies (K. Lange, Lehrbuch der Umformtechnik [Manual of Forming Technology], volume 2, Massive Forming, pages 149 to 155, Springer, Berlin, Heidelberg New York 1974; Metals Handbook 1970, 8th edition, Ohio 44073, volume 5, Forging and Casting, Locks and Counterlocks, pages 21 to 23).

When narrow workpiece tolerances are to be obtained, subsequent displacement of a die half, to be carried out after a first test, proves to be unavoidable. This can necessitate a laborious series of tests, since it is possible to approach the ideal situation only in steps, because the pressing operating has to be interrupted each time and it is necessary to wait for the workpiece and possibly the die to cool. Repeated verification of the measurements of the workpiece is expensive and requires a large amount of time, since the workpiece also has to be machined mechanically (deburred) before measurement, so that its form and dimension can be assessed. The forging press is at a standstill during these idle times.

For the reasons mentioned above, there is a considerable need, especially in isothermal drop-forging, to improve the work process and make it more efficient.

The object on which the invention is based is to provide a process and an apparatus, by means of which, especially in isothermal drop-forging with heated dies, narrow workpiece tolerances can be achieved in a simple way, economical production being ensured at the same time. The method and equipment will be such that they can be used even by personnel with little experience and little training.

This object is achieved by means of the features indicated in the characterizing clauses of claim 1 and claim 5.

The invention is described with reference to the following exemplary embodiment explained in more detail by means of Figures.

Figure 2:
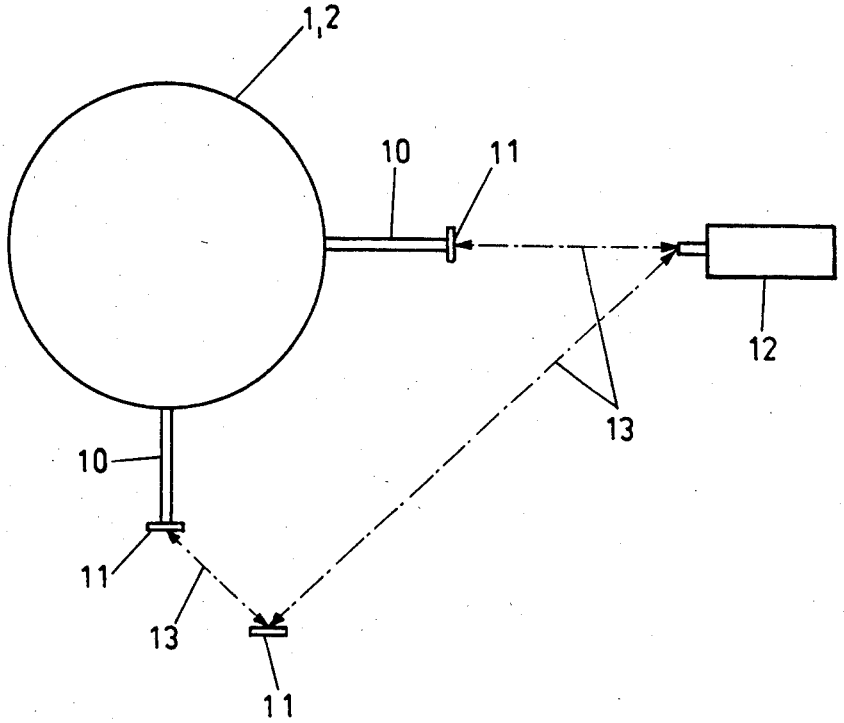
Figure 3:
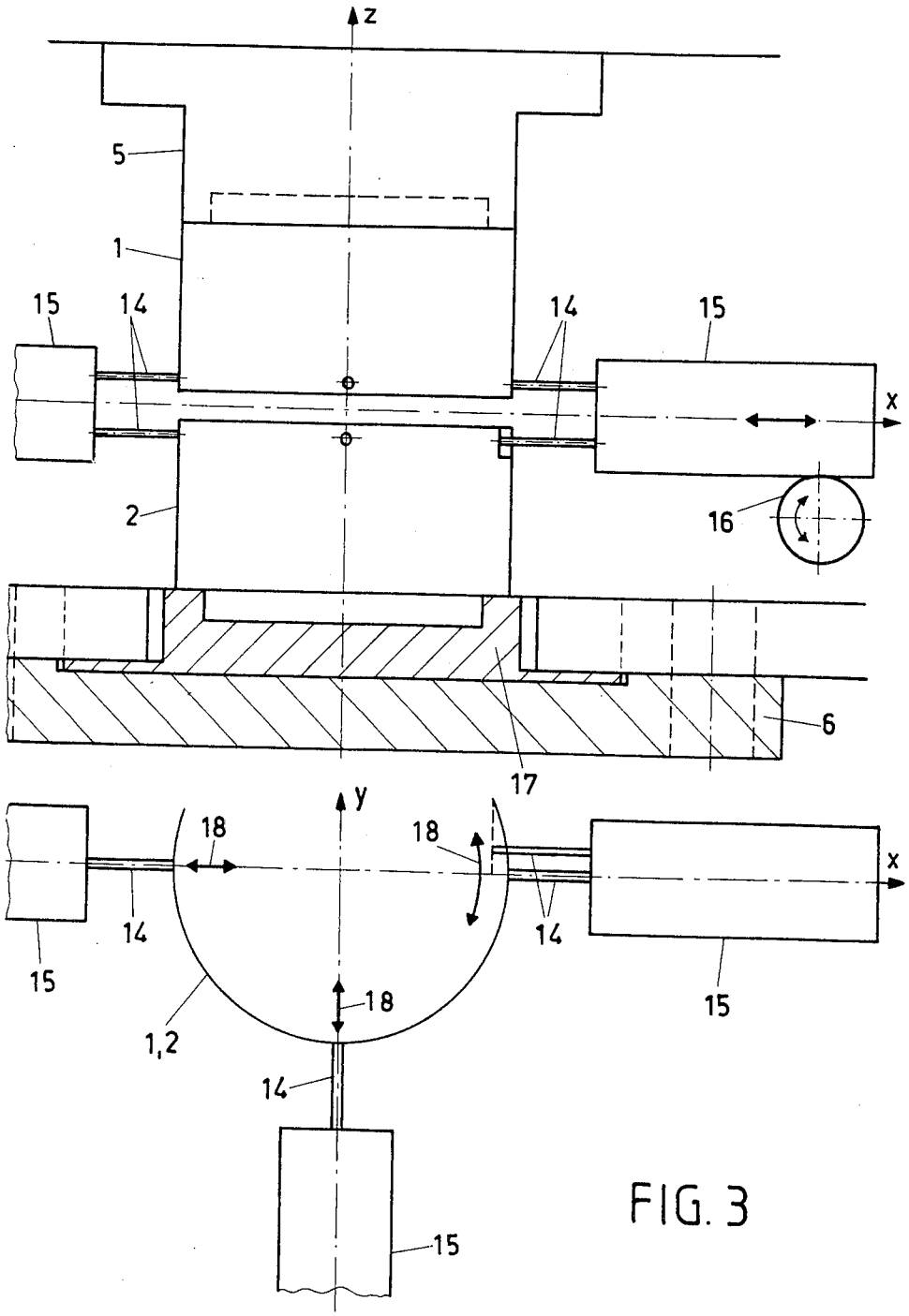
Figure 4:
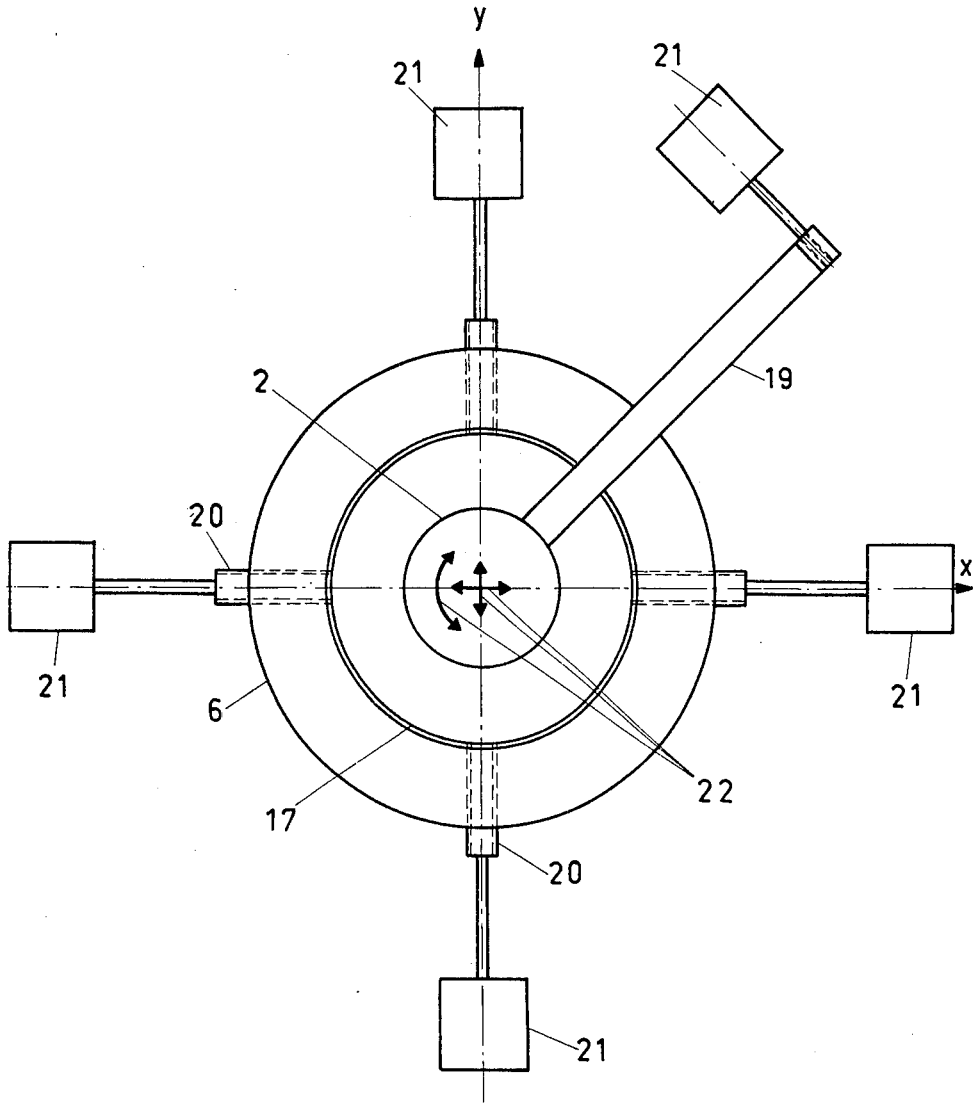
Figure 5:
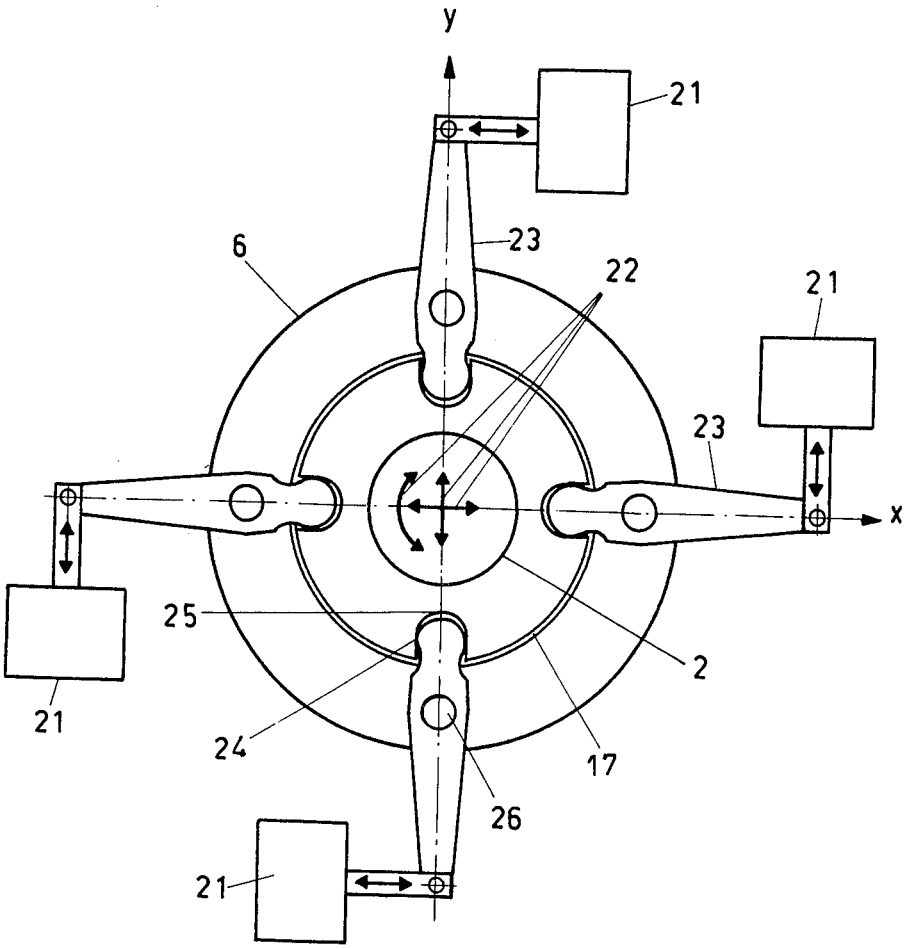
Figure 6:
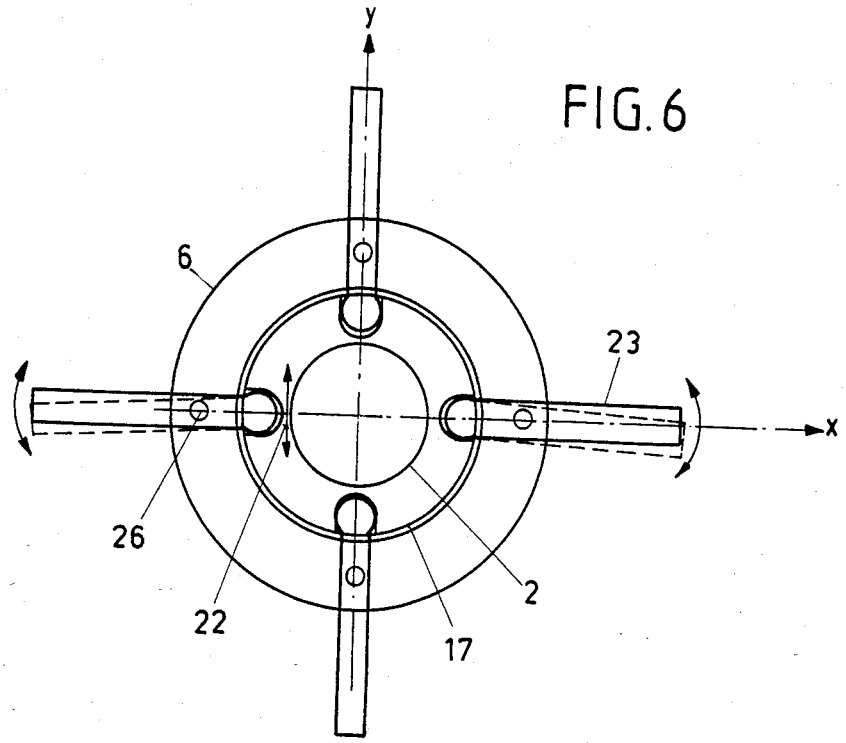
Figure 7:
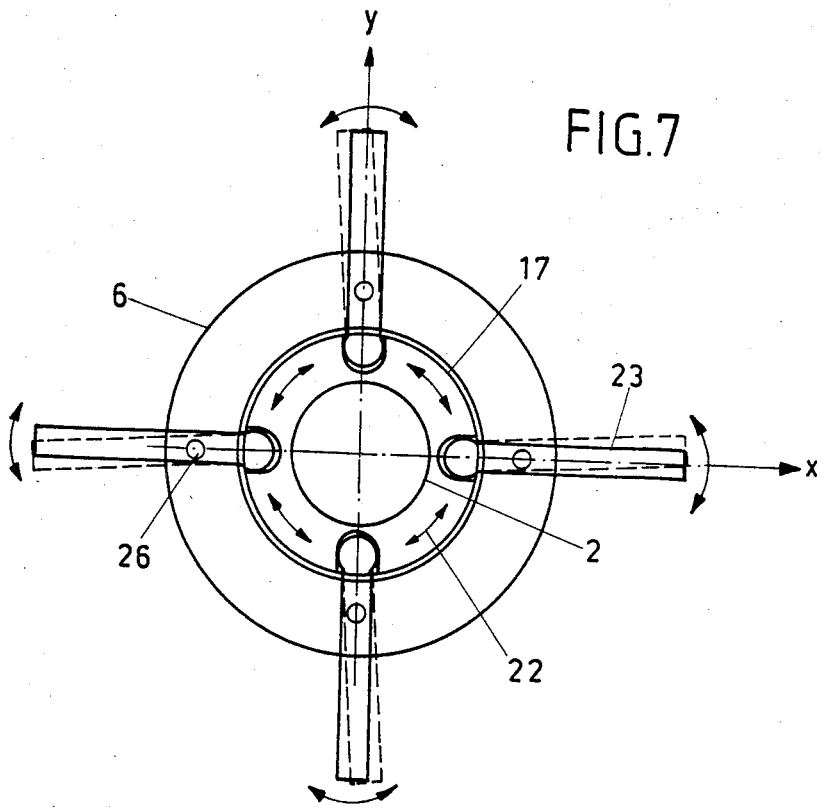
Figure 8:
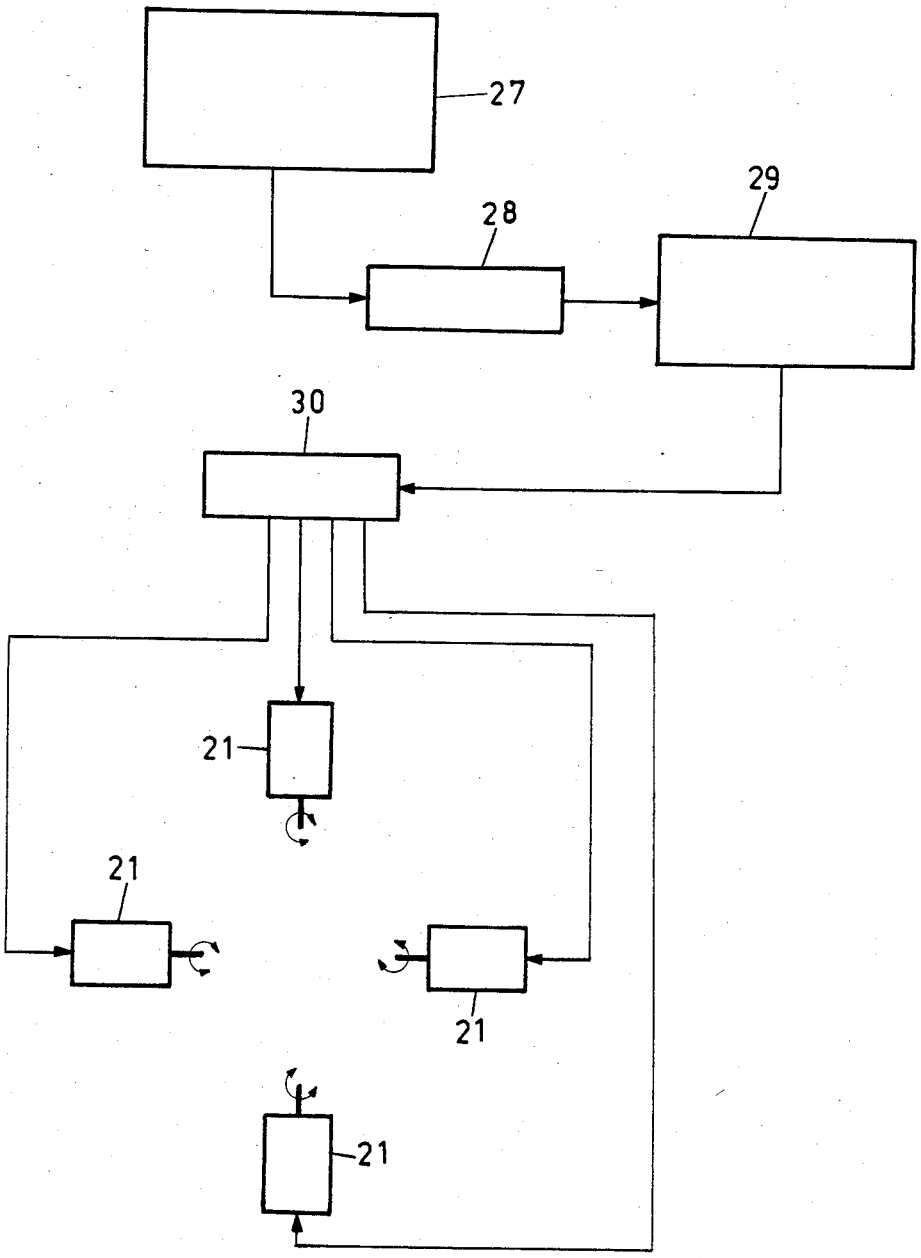

In the drawing:

FIG. 1 shows diagrammatically a vertical projection of a forging press with the associated die halves, FIG. 2 shows a diagrammatic representation of a principle of measurement for the die using a laser interferometer, FIG. 3 shows, in a vertical projection/section and a horizontal projection, the arrangement of a measuring device for the die halves using tracers, FIG. 4 shows a horizontal projection of the basic arrangement of a displacing device for a die half using set screws, FIG. 5 shows, in a horizontal projection, the basic arrangement of a displacing device for a die half using levers, FIG. 6 shows a diagrammatic representation illustrating the displacement of a die half in the xy plane by means of a lever mechanism, FIG. 7 shows a diagrammatic representation illustrating the rotation of a die half in the xy plane by means of a lever mechanism, FIG. 8 shows a block diagram of the basic process cycle.

FIG. 1 shows diagrammatically a vertical projection of a forging press together with the associated die halves, in order to illustrate the problem involved. Certain conditions of symmetry have been assumed here, and a suitable system of co-ordinates passing through the virtual center of the press and having the axes x, y and z has been chosen, the z axis coinciding with the pressing direction (the direction of movement of the plunger or press plate). 1 denotes the upper die half and 2 the lower die half, these being fastened respectively via appropriate intermediate members to the upper press plate 3 movable in the direction z and to the lower fixed press plate 4. The corresponding upper base plate (5) and lower base plate (6) are firmly screwed directly to the press plates 3 and 4 respectively. The base plates 5 and 6 themselves carry the insulating bodies 7 and 8 respectively. The upper insulating body 7 is embedded firmly in the upper base plate 5, whereas the lower insulating body 8 is arranged so as to be laterally movable in the xy plane relative to the lower base plate 6. The clamping jaws 9 will guide and fix the lower base plate during the pressing process. The entire structure of the forging press including the die can be assumed, in general terms, as being centrally symmetrical relative to the z axis, with circular cross-sections of the individual components, but other cross-sectional forms (for example, square or rectangular) are also possible, of course, according to the shape and dimensions of the workpiece.

FIG. 2 shows a diagrammatic representation of a principle of measurement for the die using a laser interferometer. 1 and 2 denote the two overlapping die halves shown in a horizontal projection. 10 designates a thin bar serving as a mirror carrier, and 11 denotes in each case a mirror. 12 designates a laser generator and interferometer, on which the displacements of each of the die halves 1 and 2, transmitted via 10 and 11, can be read off on two co-ordinate axes perpendicular to one another. 13 denotes the laser beam. This principle of optical measurement of distances needs no further explanation.

FIG. 3 illustrates, in a vertical projection or section and in a horizontal projection, the arrangement of a measuring device for the die halves using tracers. Reference symbols 1, 2, 5 and 6 correspond exactly to those of FIG. 1. 14 denotes a bar-shaped measuring tracer, and 15 designates the associated cooling jacket serving for cooling it. 16 denotes the corresponding feed mechanism intended for bringing the measuring-tracer/cooling-jacket unit into the position provided. 17 designates the adjustment plate carrying the lower die half 2 and movable in the xy plane. The arrows 18 represent the measuring directions to be detected. The axes x, y and z correspond to those of FIG. 1.

FIG. 4 shows, in a horizontal projection, the basic arrangement of a displacing device which is intended for a die half and which is supported on set screws. The reference symbols 2 and 6 correspond to those of FIG. 1. 19 denotes a radially arranged rotary arm which is embedded in the adjustment plate 17 and which allows the lower die half 2 to rotate. The lateral connection in the direction x or y (in the xy plane) is made by means of set screws 20. 21 designates the servo-motor belonging to each set screw 20 or to the rotary arm 19. The directions of movement are indicated by the arrows 22.

FIG. 5, showing a horizontal projection, relates to the basic arrangement of a displacing device intended for a die half and supported on levers. The significance of the reference symbols 2, 6, 17 and 21 can be taken from FIG. 4. The lower die half 2 can be rotated or displaced in the xy plane by means of a total of four adjusting levers 23 which are arranged on the axes x and y and engage by means of their joint-heads 24 into corresponding joint-cups 25 of the adjustment plate 17 and which are each rotatable about a pin 26. The possible directions of movement 22 are marked by arrows.

FIG. 6 shows a diagrammatic representation illustrating the displacement of a die half in the xy plane by means of a lever mechanism according to FIG. 5. All the reference symbols correspond to those of the latter Figure. The example shows a pivoting movement in opposite directions, represented by arrows and broken lines, which is executed by the adjusting levers 23 arranged on the x axis, and this signifies a displacement of the lower die half 2 in the direction y, indicated by arrows 22.

FIG. 7 shows a diagrammatic representation illustrating the rotation of a die half in the xy plane by means of a lever mechanism according to FIG. 5. All the reference symbols correspond to those of the latter Figure. The example shows a pivoting movement in the same direction, represented by arrows and broken lines, which is executed by all the adjusting levers 23, and this signifies a rotation of the lower die half 2 in the xy plane about the z axis (not shown, but perpendicular to the drawing plane), indicated by arrows 22.

FIG. 8 shows a block diagram of the basic cycle of the present work process. The individual means required for carrying out the process are indicated diagrammatically by rectangles. 27 denotes the measuring device as a whole (for example, according to FIG. 3). 28 designates an electronic data processor I (translator) which converts the measurement data into a suitable form and which transmits them to the computer 29. Here, the additional data necessary for the correction (displacement or rotation of the lower die half 2) of the die position are entered, and the resulting control command is sent to the servo-motors 21 via the electronic data processor II (translator). The control circuit is closed mechanically (not shown) by the die which is connected to the measuring device 27. Embodiment example:

A workpiece blank in the form of a stepped double cone was forged isothermally. The blank had the following dimensions:

Axial length: 120 mm
Maximum diameter: 45 mm
Diameter at the thick end: 30 mm
Diameter at the thin end: 15 mm The workpiece blank consisted of a material bearing the brand name "Nimonic 901" and had the following composition:

C=0.04% by weight
Si=0.3% by weight
Cu=0.15% by weight
Ni=42.5% by weight
Fe=33.6% by weight
Mn=0.4% by weight
Cr=13.0% by weight
Ti=3.0% by weight
Al=0.2% by weight
Co=0.8% by weight
Mo=6.0% by weight
B=0.015% by weight In a first process step, a first workpiece blank was initially heated to a temperature of 1,100° h. in a furnace and was then introduced into a press fitted with heated dies and designed for isothermal forging. The upper die half (1) and lower die half (2) had a cylindrical form and an outside diameter of 250 mm. They consisted of a molybdenum base alloy, but could just as easily have consisted of a specially heat-resistant nickel base alloy. The die halves 1 and 2 had been pre-heated to a temperature of 1,050° C.

The workpiece blank was then formed isothermally. into a forging in an initially conventional way. This forging had an asymmetrical shape and in its thin part possessed convex and concave limiting surfaces. At its thicker end, it had a maximum width (approximately in the direction y, FIG. 3) of about 40 mm and a maximum height (approximately in the direction z) of about 30 mm, whereas it had, for example in the center of the thinner part, a width (approximately in the direction y) of about 40 mm and an average thickness (approximately in the direction z) of about 5 mm, with a maximum thickness along one edge of the thinner part of about 15 mm. Its total length (approximately in the direction x) was about 125 mm. This first process step of isothermal pressing lasted approximately 10 minutes. The high asymmetry of the forging produced forces in the xy plane which resulted in a relative displacement of the lower die half 2 in relation to the upper die half both in the direction x and in the direction y and also in a rotation about the z axis, since the press is not infinitely rigid. These variations in the relative position of the die halves 1 and 2 were measured, in the closed pressed state, by means of a measuring device according to FIG. 3, and were evaluated according to the diagram shown in FIG. 8, the appropriate nominal values being predetermined. The two die halves 1 and 2 were then separated from one another again, and the forging was taken out of the press. The lower die half 2 was then rotated or displaced in the xy plane relative to the upper die half 1 by means of a displacing device according to FIG. 5, until the supposedly best possible correction was obtained. Neither the press nor the die need be cooled during this time. The correction can be made with the die halves 1 and 2 being in the hot state.

In a second process step, a second workpiece blank was heated to a temperature of 1,100° C. and introduced into the press. The entire process cycle of isothermal pressing, measurement and, if appropriate, correction was then repeated in the way described above. In general, the desired accuracy of the forging is achieved after the second or third workpiece blank has been introduced into the press. A larger series of workpieces can then be forged in succession, the position of the two die halves 1 and 2 in relation to one another being measured from time to time in the manner of a spot check and any necessary correction being made immediately.

The advantages of the new process and of the proposed devices and equipment are a saving of time, above all a considerable reduction in the idle times during the entire forging process, especially during setting-up. Moreover, the troublesome cooling and measurement of the cooled workpiece and the complicated conversion for the customary correction of all the geometrical press parameters are avoided.

We claim:

1. A process for achieving narrow workpiece tolerances in drop-forging, especially in the isothermal forging of heat-resistant materials, where the two die halves (1, 2) representing the die, which are at the workpiece temperature or virtually at the workpiece temperature, experience a movement relative to one another under the influence of the press forces, in such a way that their position relative to one another diverges from the geometrical nominal value in the course of the pressing operation, wherein a first workpiece is introduced into a forging press between the die halves, wherein, according to a first step of the pressing operation, the position of the die halves (1, 2) relative to one another is measured by mechanical means (14, 15, 16) or physical means (10, 11, 12, 14), with the die halves (1, 2) closed, in an xy plane perpendicular to the direction z of the press force exerted and is evaluated via a computer and control unit (27, 28, 29, 30) located outside the forging press, wherein, in a second step, the forging press is temporarily relieved of pressure, the two die halves (1, 2) are separated from one another and the first workpiece is removed from the forging press, and wherein the position of the two die halves (1, 2) relative to one another is positively corrected by mechanical means (6, 17, 19, 20, 21; 6, 17, 21, 23, 24, 25, 26) according to the measurement result, a second workpiece is introduced into the forging press, and in a third process step the pressing operation is completed at one stroke, with the die halves (1, 2) in their corrected position, any cooling of the workpiece and die being avoided at the same time.

2. A process as claimed in claim 1, wherein the measurement and correction of the relative position of the die halves (1, 2) in relation to one another includes both displacement in the direction x and/or the direction y and rotation in the xy plane through an angle about the z axis.

3. A process as claimed in claim 1, wherein the position of the two die halves (1, 2) relative to one another is measured by means of heat-resistant mechanical measuring tracers (14).

4. A process as claimed in claim 1, wherein the position of the two die halves (1, 2) relative to one another is measured by means of laser interferometers (12), using bars (10) designed as mirror carriers, mirrors (11) and laser beams (13).

* * * * *